United States Patent [19]

Bricher et al.

[11] Patent Number: 4,822,431

[45] Date of Patent: Apr. 18, 1989

[54] MACHINE AND METHOD FOR PREPARING A CONCRETE SURFACE FOR COATING

[75] Inventors: Charles W. Bricher, St. Paul; Mark E. Snetting, Eden Prairie, both of Minn.

[73] Assignee: Tennant Company, Minneapolis, Minn.

[21] Appl. No.: 827,956

[22] Filed: Feb. 10, 1986

Related U.S. Application Data

[62] Division of Ser. No. 688,578, Jan. 3, 1985, Pat. No. 4,586,213.

[51] Int. Cl.[4] ..... B08B 30/00

[52] U.S. Cl. ..... 134/28; 156/625; 156/635; 252/79.4; 252/143; 427/136; 427/309; 15/320; 15/321; 15/345; 15/346; 15/347; 15/353; 15/363

[58] Field of Search ..... 134/3, 28, 6, 16; 156/625, 635; 252/79.4, 143; 427/136, 309; 15/320, 321, 345, 346, 347, 353, 363

[56] References Cited

U.S. PATENT DOCUMENTS

| | | | |
|---|---|---|---|
| 3,481,879 | 12/1969 | Salomone | 134/28 |
| 3,879,789 | 4/1975 | Kasper | 15/320 |
| 4,469,525 | 9/1984 | Dodge | 134/3 |
| 4,586,213 | 5/1986 | Bricher et al. | 15/320 |

*Primary Examiner*—H. M. S. Sneed
*Assistant Examiner*—Sharon T. Cohen
*Attorney, Agent, or Firm*—Kinzer, Plyer, Dorn, McEachran & Jambor

[57] ABSTRACT

This invention is concerned with a machine and method for automatically removing a curing film or membrane from a concrete floor surface and etching that surface in preparation for applying a surface coating and doing this in less time than has heretofore been required for such floor preparation.

11 Claims, 4 Drawing Sheets

Fig. 8.
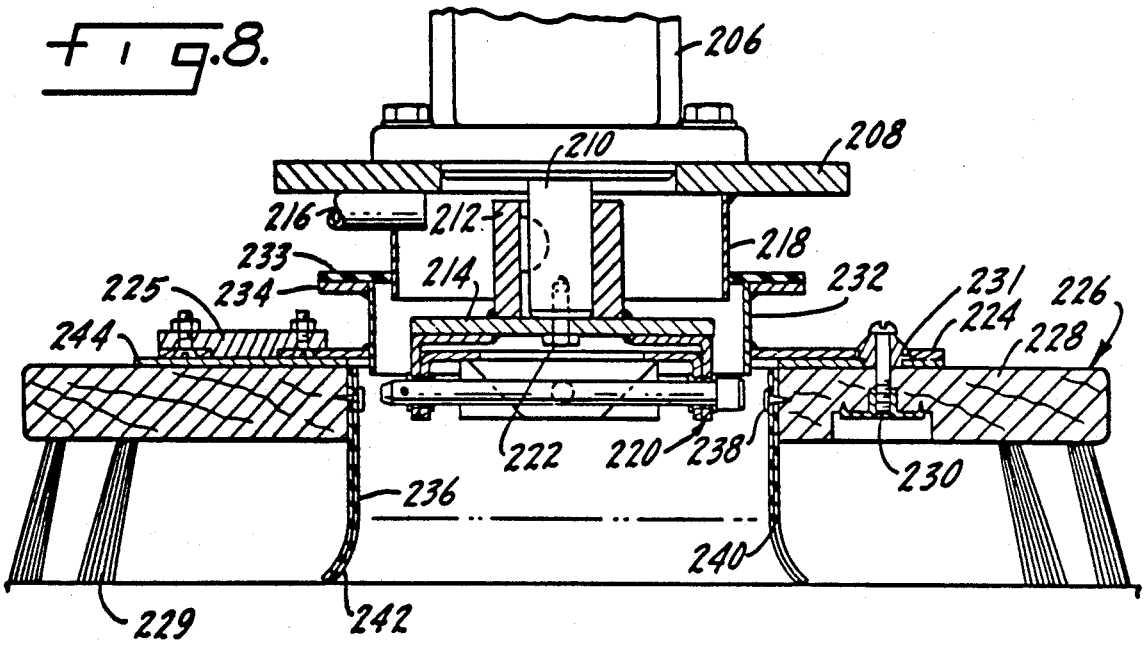
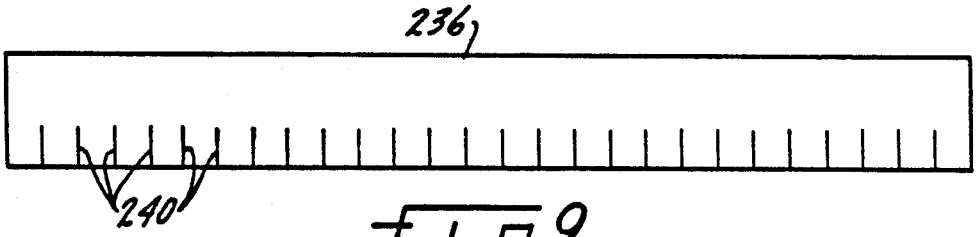
Fig. 9.
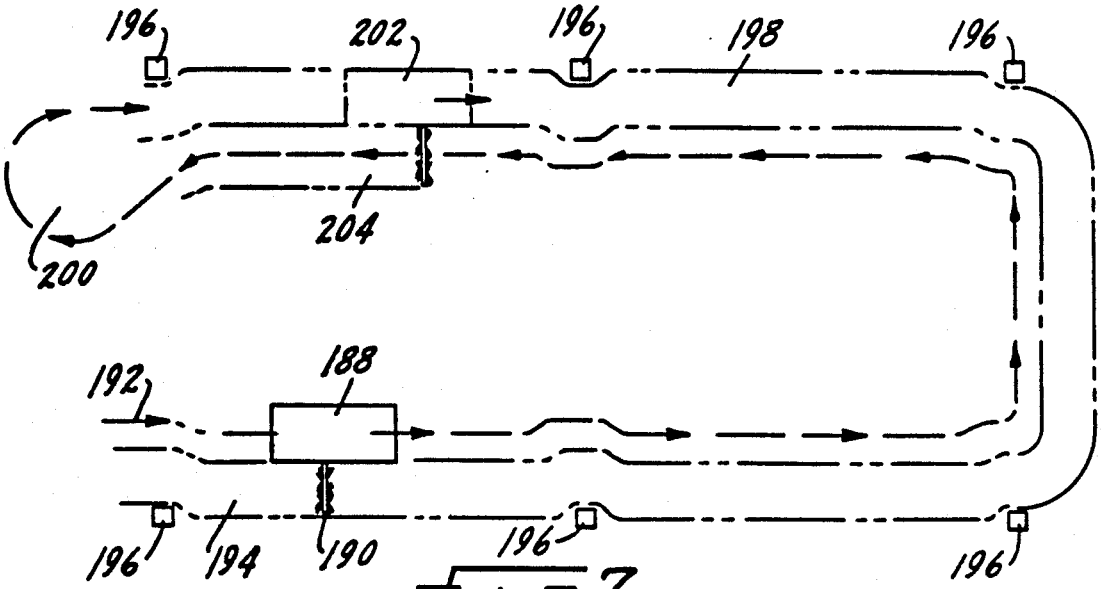
Fig. 7.

MACHINE AND METHOD FOR PREPARING A CONCRETE SURFACE FOR COATING

This is a division of application Ser. No. 688,578, filed Jan. 3, 1985, now U.S. Pat. No. 4,586,213 issued May 6, 1986.

SUMMARY OF THE INVENTION

This invention is concerned with a machine and a method for removing a curing membrane or film from a concrete floor surface and preparing the exposed concrete, by etching it, for the reception of a surface coating in as short a time as possible.

One object of the invention is a machine and method that apply a mixture of chemicals to a concrete floor surface and at the same time or in sequence therewith vigorously agitate the mixture and aggressively abrade the surface so that any curing film or membrane on the surface along with any soilage or laitance that may be ther are quickly removed.

Another object is to shorten the time required for softening and disintegrating a membrane on a concrete floor by providing means for vigorously agitating a solvent and aggressively abrading the membrane.

Another object is a machine and method of the above type that etch the exposed concrete floor surface to provide a bonding tooth for a subsequent surface coating.

Another object is a machine and method of the above type in which the spent chemical mixture is flooded and picked up along with material removed from the surface so that the surface is left clean and ready for a surface coating after a relatively short drying period.

Another object is a machine and method of the above type which first apply a solvent to the surface to soften and loosen any membrane on it followed by the above mentioned agitation, abrasion, etching and material pickup.

Another object is a machine and method of the above type in which all steps take place automatically in one compact machine.

Another object is a method of the above type which reduces the drying time by reducing the time that the floor is wetted by the chemical mixture.

Another object is a machine of the above type which can be operated by one person or possibly two.

Another object is a machine and method of the above type that reduce the required manpower and equipment necessary to prepare a concrete floor for a surface coating.

Another object is a machine and method of the above type which greatly reduce the time that a floor is "out of production" as a consequence of preparing it for treatment with a surface coating.

Another object is a machine which performs a continuous process at a constant rate for preparing a concrete floor to receive a surface coating.

Another object is a machine and method of the above type which will prepare for coating a floor which has never been coated but which has a curing film or membrane on it and possibly some grease or oil and laitance.

Another object is a machine and method of the above type which will remove curing membrane even from the areas where it is thick, for example, in low areas.

Another object is a machine and method of the above type which may use disc brush type or cylindrical brush type working tools or a combination of both types to perform the above mentioned agitation and abrasion.

Another object is a disc brush machine specifically constructed and arranged for high speed operation, meaning high speed disc brush rotation.

Another object is a disc brush machine having high speed brush rotation which feeds liquid material to the floor in such a manner that each high speed disc brush will effectively agitate the liquid on the floor.

Another object is a disc brush machine having high speed brush rotation which feeds a liquid to the floor surface through the center of each disc brush and is constructed to prevent the liquid from being thrown out through the brush before it gets down to the floor.

Other objects will appear from time to time in the enusing specification and drawings.

BRIEF DESCRIPTION OF THE DRAWINGS

FIG. 7 is a schematic diagram of a pattern of movement of a variant unit;

FIG. 8 is a side view, partly in section, on an enlarged scale, of a disc brush and its mounting; and FIG. 9 is a plan view of a part from FIG. 8 laid out.

BRIEF DESCRIPTION OF THE PREFERRED EMBOIDMENT

Figure 1:
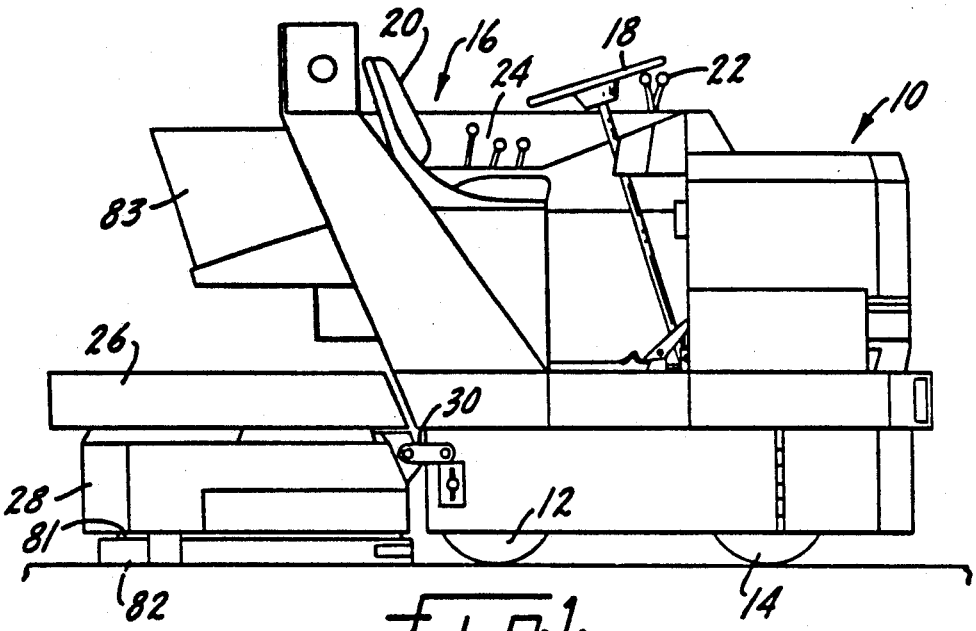
FIG. 1 is a side view of a preferred machine and method.

In FIG. 1, a machine is shown which has a main frame indicated generally at 10 with rear wheels indicated generally at 12 and a front wheel at 14. Any suitable mobility arrangement may be used and in the case of wheels, the single front wheel 14 may be steerable. The frame may include a suitable operator's position 16 with a steering wheel 18, a seat 20 and various controls, for example, scrubbing control levers 22, solution flow control lever, scrub head lock, throttle control lever, and the like, all indicated at 24, all of which may be conventional. A wraparound rear bumper 26 may enclose a scrub head unit 28 which may be connected to the main frame by a link 30 or the like so that it freely floats relative to the main frame or tractor 10.

Figure 2:
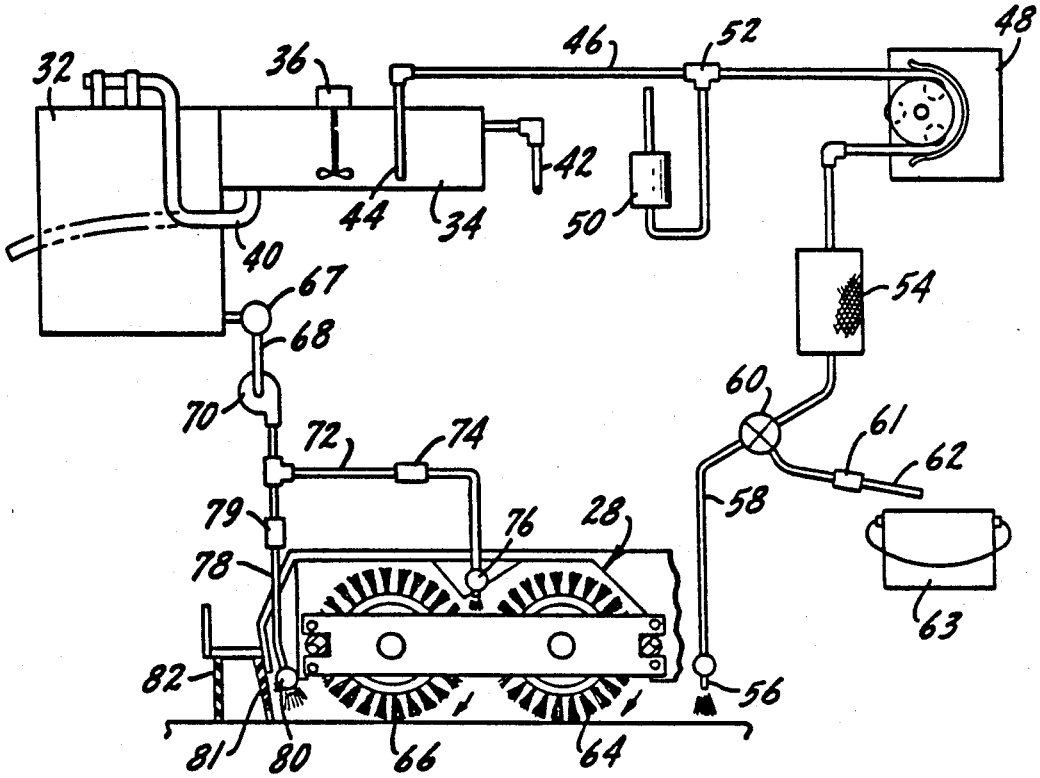
FIG. 2 is a schematic of a part of FIG. 1 with various connections.

The main frame may have a water tank 32 and a tank 34 for a liquid chemical mixture which may be referred to herein as a chemical tank, all of which is diagrammatically shown in FIG. 2. The chemical tank may have a suitable agitator, indicated generally at 36, and a drainage hose or tube 40 which is diagrammatically shown in FIG. 2 as laid back over the water tank but, when flexed out and down, is intended to illustrate a suitable gravity drainage so that the chemical tank 34 may be emptied and cleaned from time to time. A suitable water flushing connection 42 may also be connected to the chemical tank so that, for example, at night or during shutdown, the hose 40 may be connected to a drain and the chemical tank flushed with water through connection 42.

A liquid chemical mixture from the tank 34 may be conveyed by a suitable pick-up 44 through a tube 46 to a metering pump diagrammatically indicated at 48. The supply line 46 may have a suitable solenoid valve 50 connected into the supply line, as at 52, so that the liquid chemical supply system may be vented to the atmosphere, for example, during shutdown so that the supply connections between the tank and the scrub head to be described hereinafter do not function as a siphon.

The pump 48 supplies chemicals to and through, for example, a filter 54 through line 58 to a set or series of supply nozzles 56, for example, three, mounted across the front of the scrub head 28. Line 58 may have a three-way valve 60 which, when actuated, may supply chemicals through a restrictor 61 and side branch 62 to a bucket 63 for calibration purposes, the restrictor 61 being set to duplicate or simulate the restriction of the nozzles 56.

The scrub head 28 is indicated diagrammatically in FIG. 2 with the arrangement being generally the same relative to the overall machine as that shown in FIG. 1 so that the scrub head in FIG. 2 may be assumed to move to the right. Two cylindrical brushes 64 and 66 are shown as rotatably mounted in the scrub head in the manner such that from time to time they may be removed, reversed, possibly to even out wear, adjusted, and replaced when worn out. All of these details have not been shown as they are conventional and not important to the present subject matter. The forward brush 64 is shown as rotating clockwise, as is the rear brush 66, for reasons explained hereinafter.

The nozzle or dispenser arrangement 56 ahead of the brushes supplies a suitable quantity of a chemical mixture to the surface being treated which may be assumed to be a concrete surface with a membrane or film that is to be removed, for example, a membrane that has been applied to a fresh concrete surface where the membrane holds in moisture to assure complete curing of the concrete. Such a membrane may be on the order of one to three mils. of thickness and may be made of, for example, chlorinated rubbers, acrylic resins and the like. The membrane must be removed before the concrete can be etched prior to the application of a standard coating, such as a polyurethane or the like.

The chemical mixture supplied from the tank 34 to the spray head or nozzles 56 may be assumed to be a mixture of an aromatic solvent (for example, WC150 from Worum Chemical Company) and a solution which is a combination membrane remover and etchant. This solution may be comprised of a strong ionizable acid, anorganic solvent, a co-solvent, a weak acid and a surfactant. For additional detail and examples of the type of chemical solution that may be used, attention is directed to U.S. Pat. No. 4,469,525, issued Sept. 4, 1984, and assigned to the present assignee.

The organic solvents in the above solution are capable of softening and dissolving membranes such as those described above. This action may be augmented by mixing some relatively low cost aromatic solvent with the solution, which will permit the use of less of the relatively expensive solution and hence reduce the cost of the operation. The acids in the solution are capable of etching bare concrete from which the membrane has been removed, but to do so, they must be activated by the addition of water.

In the following discussion, for the sake of brevity, the above solution will be referred to simply as "solution", the aromatic solvent mentioned earlier will be referred to as "solvent", and the mixture of the two will be referred to as "chemical mixture". It is the nature of this mixture that it must be constantly stirred or agitated to prevent separation of the solvent and the solution.

As the chemical mixture is supplied to the nozzles 56, the solvents included therein which are applied to the film or membrane begin to dissolve the membrane at a position or location ahead of the first brush 64. The brush thereafter violently agitates the dissolving membrane and the mixture. Brush 64 as well as brush 66 are of a rugged or tough makeup or composition so that the abrading of the membrane or film and the agitation or working of the solvents is substantial, and this abrading of the film and agitation of the solvents greatly reduce the time required to remove the film as compared to the time required for the undisturbed solvents to remove it when acting without abrasion and agitation being present.

The water tank 32 supplies water through a valve 67 and supply line 68 with a centrifugal pump 70 with one branch 72 passing through a restrictor 74 to a nozzle or series of nozzles or outlet connections 76 on the scrub head at a location between the brushes so that a certain amount of water may be supplied to the surface between the brushes, which is to say, after the first brush 64. The second branch 78 of the water connection has a restrictor 79 leading to a spray head 80 suitably positioned on the scrub head after the second brush 66. Variously sized orifices available for the restrictors 74 and 79 in the two branches enable calibration of the amount of water being supplied to the nozzles or outlets 76 and 80.

In practice, a mixture of solution and solvent, for example, in a one to one relationship, is supplied to the forward nozzles 56 so that the solvents included in the mixture disolve the membrane as it is being abraded by the forward brush 64. The acids included in the mixture and applied to the surface by the forward nozzles 56 are inactive and are merely present during the abrading by the forward brush 64. The membrane, when dissolved, abraded and lifted by the agitating action, forms what may be termed an emulsion with the chemical mixture. Thereafter a relatively precise amount of water is supplied by the nozzles 76, which is to say enough water is supplied to activate the acid in the emulsion. Assuming that the chemical mixture supplied by the forward nozzles 56 is on a one-to-one ratio between solution and solvent on a given time basis, two parts of water could be supplied by nozzles 76 which would activate the acids in the solution which would then etch the exposed concrete surface. The emulsion, including the dissolved membrane, the solvent and the solution in which the acids are now activated, is then subject to the further abrasion and agitation of the second brush 66 which greatly augments the etching so that adequate etching is accomplished by the time brush 66 has passed over the surface.

The nozzles 80 are calibrated by the restrictor 79 to supply a large quantity of water to the emulsion, which is to say, it is flooded. This facilitates flushing the surface and picking up the emulsion with the vacuum squeegee 82.

While the general appearance of the tractor and scrub head in FIG. 1 may appear conventional, modifications and variations are necessary and/or desirable. For example, cylindrical brushes in a standard scrubber rotate at a speed on the order of 400 r.p.m. The cylindrical brushes in the present machine and method are much faster and rotate on the order of 800 r.p.m. The scrub head itself is connected to the tractor in conventional manner by a flexible linkage arrangement of any suitable type, as generally indicated at 30, so that the scrub head floats and its full weight can be brought to bear on both brushes, but the scrub head in a standard scrubber of this type might weigh on the order of 400 lbs. whereas in the present unit, its weight has been increased to something on the order or 600 lbs. A part of this may be a heavier drive configuration for the brushes and in addition dead weight may be used.

In addition, rather than using standard brushes which have a 0.050 inch diameter bristle of a type known as Tynex A supplied by DuPont which is made of a water resistant nylon filled with silicon carbide grit, it is preferred that a larger or stiffer or tougher bristle be used, for example, on the order of 0.060 inch diameter Tynex A which, in combination with the additional weight of the scrub head and the higher speed of the brushes, will greatly facilitate abrasion and effected dissolving of the membrane by the first brush 64 and etching of the concrete by the second brush 66.

In addition, the machine moves very slowly, for example, on the order of twenty (20) feet per minute, which is substantially slower than a conventional scrubber. If the rear or etching brush 66 is rotated counterclockwise, which is conventional in a standard scrubber, a pool of emulsion would build up between the brushes because the rear brush 66 would be sweeping the emulsion forward and at the slow travel speed the emulsion would flow out the sides of the scrub head. With both brushes 64 and 66 rotating clockwise, the movement of the rear brush as it contacts the floor tends to sweep the emulsion rearwardly so that a pool does not build up between the brushes and hence the emulsion does not flow out the sides but remains contained within the scrub head.

In addition, a drag skirt 81 is positioned after the flooding nozzle 80. The drag skirt 81 is in the nature of a rubber skirt with slots or openings formed at suitably spaced intervals along the lower edge which tends to hold a pool of emulsion in that area long enough for adequate etching to take place and also to rinse the entire surface, including high spots but, at the same time, a controlled flow of emulsion is allowed through the slots which are provided so that there is a partial control for retention of the emulsion but at the same time excessive buildup is prevented.

Thereafter, a squeegee or vacuum pickup of any suitable type may be used, as indicated generally at 82, which is in the nature of a skirt suitably positioned on or after the scrub head with a vacuum connection, not shown in FIG. 2, so that the flooded emulsion is now picked up which allows or causes the surface to dry rapidly. A suitable vacuum pickup squeegee is described in U.S. Pat. No. 4,037,289 issued July 26, 1977 and assigned to the present assignee. The squeegee and and vacuum pickup system may convey the spent chemical mixture, membrane, and water emulsion through a suitable connection, not shown, to a recovery tank 83 which should be made of stainless steel or other material that will resist chemical attack.

Figure 3:
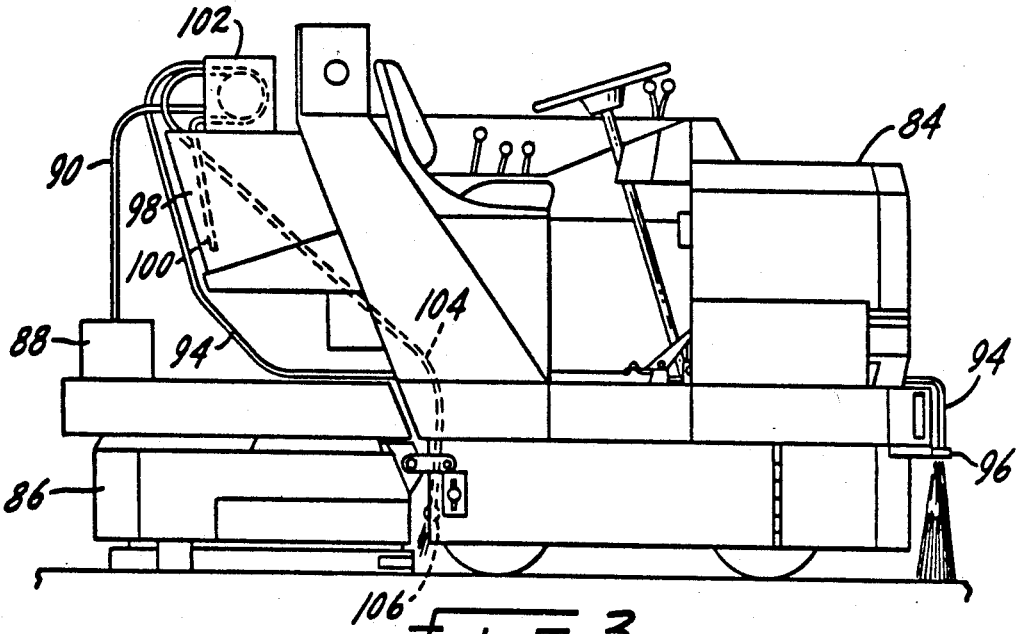
FIG. 3 is a side view of a modified form.
Figure 4:
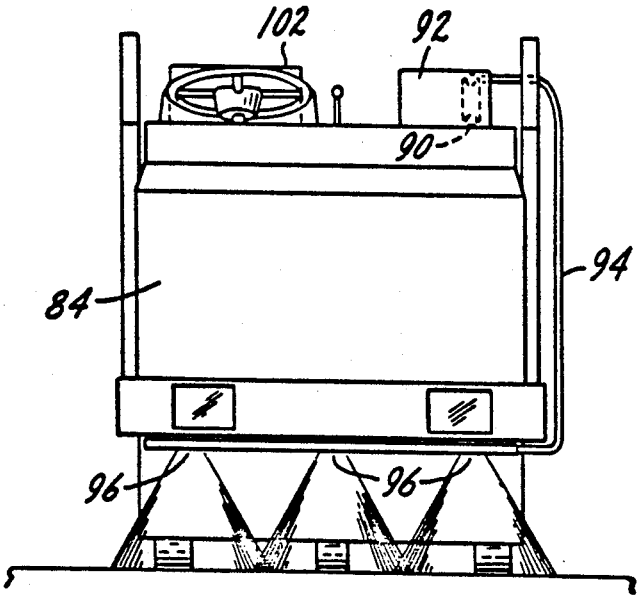
FIG. 4 is a front view of FIG. 3.

A similar or variant machine is shown in FIG. 3 with the frame or tractor 84 having a suitable scrubbing and agitating unit 86 thereon. If a condition is met where a membrane resists removal by the above described machine and method, a presolvent unit or system may be used which includes a tank 88 which supplies presolvent through a line 90 to a metering pump 92 and then through a line 94 to a plurality of spray nozzles shown as 3 in FIG. 4 and designated 96 on the front of the machine so that the presolvent has additional time to soften the membrane before the regular chemical mixture is applied. The spray nozzles 96 may be held on the front of the machine by magnets or any suitable releasable type of mounting so that they will come off easily if the unit hits an obstacle. The aforementioned chemical mixture is supplied from a chemical tank or container 98 which has a line 100 connected through a similar metering pump 102 to supply chemical mixture through line 104 to spray nozzles 106 which may be the same or similar to those indicated at 56 in FIG. 2 ahead of the agitating stations.

In an arrangement such as FIG. 3 where a presolvent is being supplied separately and ahead of the regular chemical mixture, an aromatic hydrocarbon solvent may be used as the presolvent because it is relatively inexpensive. A suitable example solvent might be WC150 supplied by Worum Chemical Company. This is also true of the presolvent supplying arrangement described hereinafter in connection with FIG. 6, if used in that machine and method and also the sidebar arrangement discussed and disclosed later in connection with FIG. 7.

A further modification is shown and described in connection with FIGS. 5 and 6 in which the machine frame 118 is similar to 10 of FIG. 1. It may have a scrub head at 120 on the rear thereof connected to float in a manner similar to 28 of FIG. 1 so that the full weight of the scrub head or unit 120 is on the floor. Whereas the agitator units previously described had cylindrical brushes, FIGS. 5 and 6 use or employ a plurality of disc brushes 122 which, in the present embodiment, is shown as three units in FIG. 6, 122A being the upper brush, 122B the middle brush, and 122C the lower brush. The two on the sides, 122A and 122C, lead and the middle brush 122B follows with their peripheries slightly overlapping in their line of movement so that the entire surface is effectively treated. Such a variant arrangement using disc brushes instead of cylindrical brushes might be preferred by some who are accustomed to using scrubbing machines equipped with disc brushes. Two advantages of using a disc brush type machine are said to be first that disc brushes have a greater brush contact area on the floor than cylindrical brushes do and second, they give closer conformance to uneven floors because the disc brushes are indivdually suspended and gimbal mounted.

A tank 124 for the chemical mixture has a suitable agitator 126 and is constructed and arranged to supply the chemical mixture through a connection 128, which may have an air venting arrangement with a solenoid valve control 129, to three pumps 130 from a header or manifold 132. Each pump 130 supplies the chemical mixture through a line 134 to the center of one individual brush.

A separate presolvent tank 136 may supply a suitable presolvent, such as an aromatic hydrocarbon solvent, through a line 138 which has a pump 140 to a divider or header 142 and then through separate lines 144 to spray heads 146 which are constructed, arranged, and disposed to supply a presolvent to the surface ahead of the rotary brushes 122A–C. The presolvent applying arrangement 136–146 is in the nature of the presolvent unit 88–96 in FIGS. 3 and 4 and may or may not be used, depending upon the application, meaning the difficulty of removing a membrane which may be on a concrete floor.

A suitably arranged water tank 148 supplies water through a line 150 which may have a solenoid valve 152 and a centrifugal pump 154 to separate lines 156 and 158, each of which may have an adjustable restrictor 160. Line 156 branches into three separate lines 162, each of which may have a restrictor 164. The three lines 162 also connect to the centers of the disc brushes so that water is added to the center of each brush to mix with the chemical mixture which has been supplied through lines 134.

The supply system from the chemical tank 124 through the lines 134 to the center of the brushes supplies a certain amount of chemical mixture which may be one part solvent and one part solution. Water is added to this through lines 162 in a metered amount, i.e. one part of water to one part of solvent and one part of solution. The water added is not enough to activate the acids in the solution but increases the volume of liquid supplied to the membrane on the floor so that as the membrane is dissolved by the solvents and agitated by the brushes, the water will enter into an emulsion that will flush the membrane out from under the brushes. This is necessary when using disc brushes because the area of contact of the disc brushes with the floor is much greater than that of the cylindrical brushes.

The other water line 158 leads to two nozzles positioned behind the disc brushes 122A–C, the upper one being designated 166A and the lower one 166B. These nozzles deliver a shaped spray, which is to say a fan spray, so that they function in a particular fashion with the water being delivered under enough pressure and force so that as the machine moves slowly forward across the floor, the jet spray of these nozzles rolls the water forwardly into the area of the brushes and keep it in a puddle moving in front of the nozzles. This is to say the emulsion is constrained somewhat between the blast of these nozzles and the backsides of the brushes in a turbulent action. In addition, the added water from the nozzles 168A,B is sufficient to activate the acid which is in the emulsion coming out from under the brushes. The result is that while the acid is being activated and etching the exposed concrete, the water blasts from nozzles 166A,B also are sufficiently turbulent that this constitutes an agitation of the surface while it is being etched.

In addition the water blasts from nozzles 166A,B will force the mixture to a degree back into contact with the peripheral bristles on the brushes, meaning just the outer bristles on those brushes, particularly the middle brush 122B, so that while the acid is being activated and is etching, the peripheral bristles will also abrade the surface being etched. This abrasion speeds up the etching process.

In addition the particular orientation of nozzles 166A,B is important. The lower nozzle 166B is oriented toward the gap between disc brushes 122B and C. The counterclockwise rotation of the middle brush causes it to tend to carry the water through the gap and around itself and out between it and the upper brush 122A. At this point in the circuit, it is traveling toward the rear of the machine. Upper nozzle 166A is directed about 30° down from a horizontal line as indicated at X in FIG. 6. The water coming out from between the middle brush 122B and the upper brush 122A hits the blast of water from the upper nozzle 166A and is constrained into a channel that makes it flow on around the center brush 122B and then pass out between the two nozzle blasts 166A and 166B about on the centerline of the machine or possibly a little to the right of it and then on to the squeegee. Thus the nozzles 166A and 116B, in addition to participating in the activation of the acid and agitation of the emulsion, also funnel the flow of water and emulsion to the squeegee pickup. This is partially accomplished because the nozzles deliver shaped sprays, which is to say fan sprays, and they are disposed to direct the sprays in planes forward and down at about 20° to 30° from the vertical.

Figure 5:
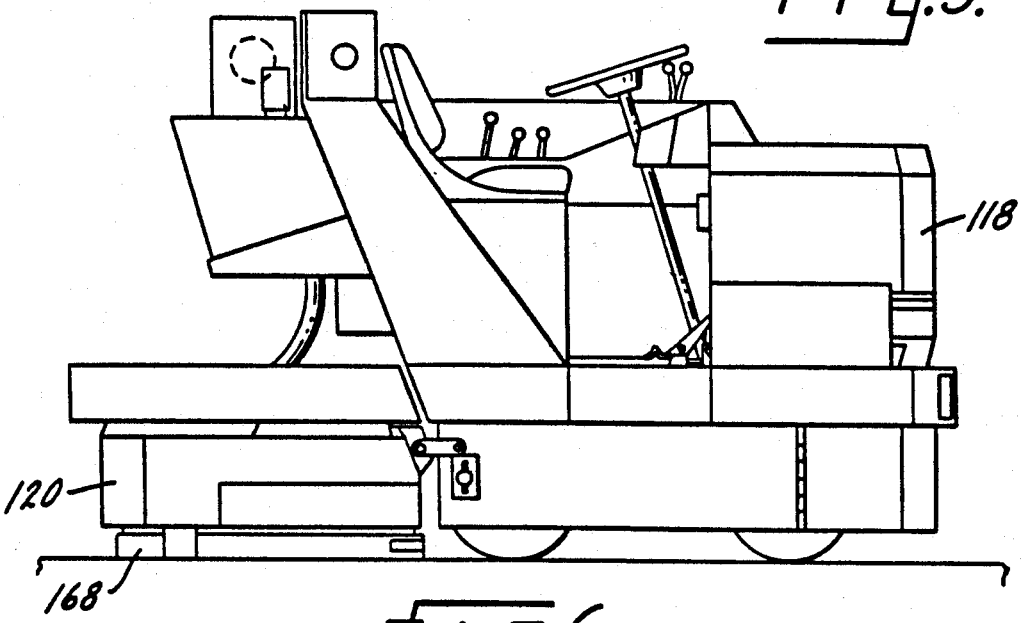
FIG. 5 is a side view of a further variant.
Figure 6:
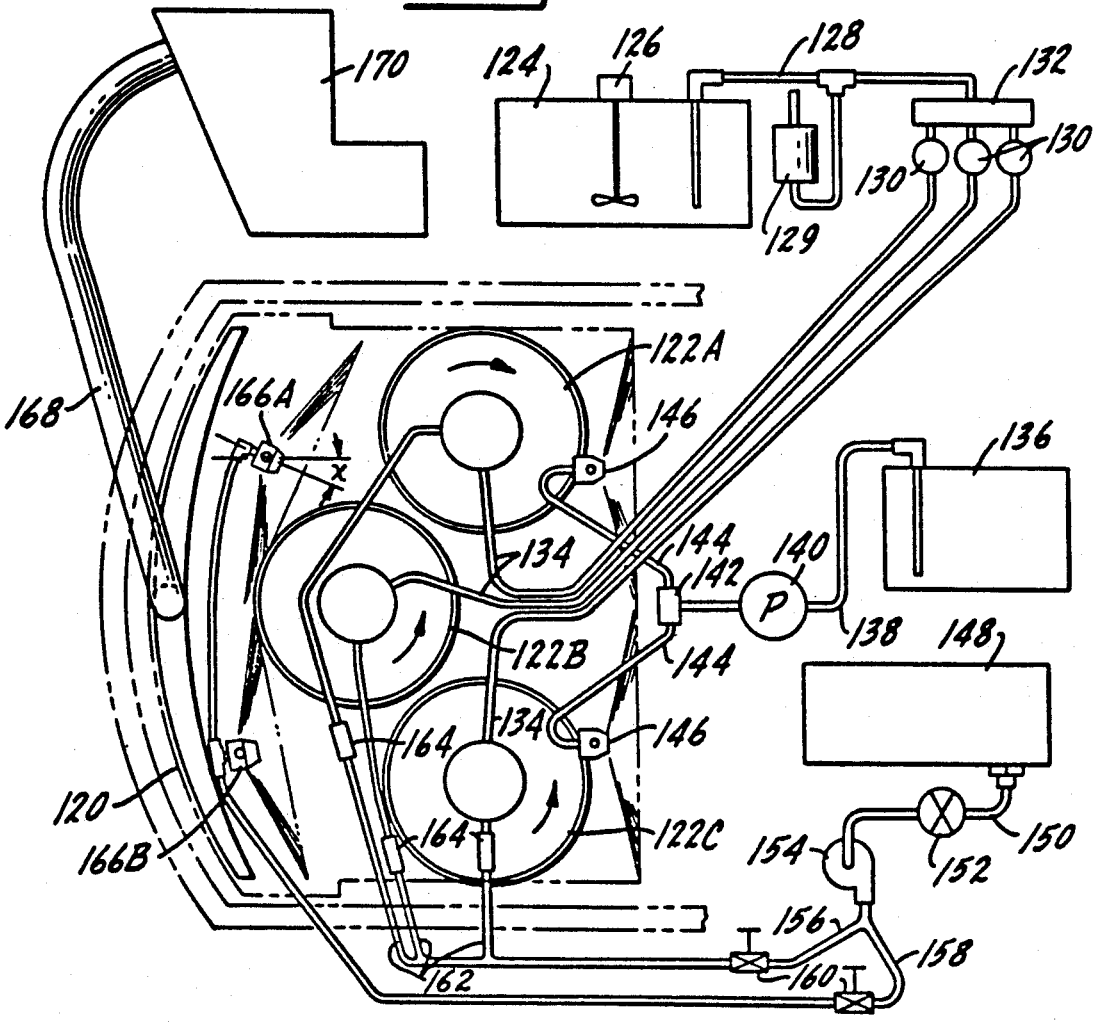
FIG. 6 is a schematic of the general flow arrangement of FIG. 5.

As in the case of the scrub head in FIGS. 1 and 2, the scrub head in the disc brush machine of FIGS. 5 and 6 should also be heavy, for example, on the order of 600 lbs. The entire scrub head should float so that the full weight is taken by the floor and the bristles should be of extra strength and size to carry the extra weight. 0.060 inch diameter Tynex A from DuPont is a good bristle material here also. Additionally, the disc brushes should be speeded up, say, something on the order of 800 r.p.m., whereas in standard disc brush scrubbers, the disc brushes are run at something on the order of 150 r.p.m.

In addition, the nozzles 166A,B supply sufficient water such that flooding takes place which floats the emulsion off the floor. This is followed by a suitable squeegee and vacuum pickup arrangement 168 so that the flooded mixture of solvents, acids, water and membrane is then taken to a suitable recovery tank 170.

In FIG. 7, a variant form has been shown which is useful in certain cases where a membrane is unusually difficult to remove. This method applies presolvent to the floor and gives it an extended time to soak and soften the membrane before the machine workes the area. In FIG. 7, a boom is used which extends out from the side of the machine. FIG. 7 is a pattern of a machine, indicated generally at 188, which may be a cylindrical brush machine like in FIGS. 1 and 2 or a disc brush machine like in FIGS. 5 and 6, moving around a given floor surface with a boom 190 extending to the side of the machine and applying presolvent to a path or area that is adjacent to the path or area that the machine is actually moving on. As shown in FIG. 7, the machine starts on the lower left hand side and moves along a path indicated by arrow 192 that is adjacent to the path or strip 194 to which the boom 190 is applying presolvent. The posts in the building are indicated generally at 196 for illustrative purposes and may be assumed to be on 40–50′ centers which is conventional. In the first path from left to right, the boom 190 of the machine merely sprays the adjacent path 194 with presolvent, turns left when it reaches the far wall, then left again at the next wall spraying a path in the upper portion of FIG. 7 adjacent the wall as indicated at 198. It will be noted that it is the outside path adjacent the walls which will be coated with the presolvent from boom 190. As indicated at 200, when the machine reaches the end wall, it reverses course in a clockwise turn. The machine, now indicated at 202, moves along the presolvent covered path 198 with chemical mixture being supplied to the brushes so that the full process is started after the machine completes its first loop 200. During this step, presolvent is also supplied by the boom 190 to the next adjacent path, indicated at 204, so that while the machine itself is fully working the initial path, the next adjacent path is being supplied with presolvent to soften and dissolve the film or membrane and there is considerable time for the presolvent to soak the membrane before the machine will arrive to work the area.

The particular path in FIG. 7 is merely one of many that could be used and under certain circumstances, the boom 190 could be made reversible so that on one pass it would be on the right side of the machine and on another pass, it would be on the left side of the machine. An automatic arrangement could move it from one side of the machine to the other and could be constructed in any suitable manner. The particular arrangement shown as having a boom extending from one side of the machine with the unit itself making multiple passes is quite effective and useful on surfaces having a membrane that is extremely difficult to remove.

In addition, it may at times be desirable to have a man walking ahead of the machine a suitable distance to apply presolvent from a pressurized tank. But again this would depend upon the particular application or problem encountered.

An important feature of a disc brush machine as described heretofore is shown in FIG. 8 which is a disc brush arrangement for applying and agitating a mixture on a membrane treated floor with the brush being capable of high speed rotation. Normally disc brushes used for floor scrubbing are rotated on the order of 150 r.p.m. In the present machine and method, however, adequate abrasion of the membrane requires rotating the disc brushes at about 800 r.p.m. At this speed any solution applied to the floor ahead of a brush will be slung away from the brush by centrifugal force and little agitation of the solution will occur. Also, if solution is introduced in the conventional manner through the hub of such a brush it will be slung out through the brush bristles by centrifugal force before it gets down to the floor. The present invention overcomes this problem by providing a means for directing a liquid through the hub of a rotating disc brush and down to the floor in the center of the brush, so that the bristles can effectively agitate it on the floor. In FIG. 8, a drive motor is indicated generally at 206 mounted on a suitable support or part of a machine frame 208 with the drive shaft 210 of the motor being keyed to a drive collar 212 with an outstanding flange 214. A tube 216 extends through a stationary cylindrical seal 218. A two axis gimbal 220 is welded or otherwise suitably connected to the motor drive shaft plate 214 which in turn is held by a bolt 222 to the bottom of drive shaft 210. A drive plate 224 extends outwardly from the gimbal. A disc brush, indicated generally at 226, with a wooden backing 228 and bristles 229 is removably connected to the plate element 224 by a plurality of peripherally spaced magnets 225. As is conventional, the brush 226 may have a steel backing plate 244 attached to it which will be engaged by the magnets 225. Rotation of the motor is transmitted to the disk brush through a plurality of screws 230 connected into the top of the brush backing 228 and fitted in peripheral holes 231 in the flange or plate 224. Plate 224 carries an upstanding cylindrical sleeve 232 with a sealing element 233 and metal backing ring 234 thereon so that seal 233 rotates with the brush and the inner edge thereof is in sealing contact with the stationary sealing cylinder 218.

A sleeve or curtain 236 is disposed on the inside of the brush and may take the form of an elongated strip, as shown in FIG. 9, of polyethylene or the like, which is rolled up into possibly a double wrap arrangement, as shown in FIG. 8, with the upper portion thereof being fastened, as at 238, to the inside of the wooden backing member 228. The lower edge of the wrapper or apron may have spaced slits 240 with the lower edge of the wrapper curtain extending somewhat below the bristles of the brush, so that the bottom edge of the wrap will be under a slight load when the bristles are in contact with the surface being worked upon. In this arrangement, the slits will flex somewhat, as shown at 242 in FIG. 8, which will cause them to open up to a degree and allow chemical mixture to be slung out at floor level to the bristles 229 where it will be agitated.

This form has the advantage that the chemical mixture is supplied through the tube 216 to the inside of cylinder 218, both of which are stationary. The chemical mixture flows down through the gimbal 220 which is rotating at a relatively high speed, for example, something on the order of 800 r.p.m. The result is that the chemical mixture will be whipped and battered into a spray. The rotating seal 233 keeps the spray inside of the brush, and the seal or curtain 236 insures that the droplets or spray will go down to and be applied effectively to the floor surface being worked upon. Without the curtain or seal 236, the spray would be thrown outwardly through the brush bristles by centrifugal force before the chemical mixture ever contacts the surface being worked upon.

It is considered desirable, in view of the nature of the chemicals being used, that the various parts of the machine be made chemical resistant. For example, the paint on a scrub head might be a chemically resistant urethane with a coating on all metal parts. In addition, the fasteners, nuts and bolts and so forth, might be stainless steel. The various chemical pumps, such as 48 in FIG. 2, and 130 in FIG. 6, should be chemical resistant and an effective unit has been found to be a Masterflex pump sold by the Barnant Company of Barrington, Ill., which is a peristaltic pump and designated their Model 7019. It is also well to have the tubing made of a chemical resistant material.

It may be desirable after the membrane has been removed to completely rinse the floor. This can be done by shutting off everything except the water pump to the rear nozzles such as at 80 in FIG. 2 or 166 in FIG. 6 and opening the restrictors fully so that the floor is flooded and then go across the floor, spraying a lot of water and picking it up with the squeegee.

Whereas the preferred form of the invention and several variations have been shown and described, it should be understood that suitable modifications, variations and/or improvements may be made without departing from the invention's fundamental theme.

We claim:

1. A method of removing a membrane adhering to a concrete surface, such as a floor, and at the same time etching the surface to prepare the surface for the application of a coating, including the steps of applying a mixture to the surface which includes a solvent effective to soften and loosen the membrane and an inactive acid, thereafter mechanically agitating the mixture and, at the same time, abrading the membrane with the mixture thereon to rapidly loosen and disintegrate the membrane so as to expose the concrete, thereafter applying sufficient water to the thus abraded and disintegrated membrane and the mixture so as to activate the acid, immediately thereafter further agitating and abrading the surface so that the activated acid will quickly etch the exposed concrete, thereafter applying sufficient additional water to flood the surface, and immediately thereafter removing the mixture and water so that the etched exposed concrete is ready for a new surface coating after a relatively short drying period.

2. The method of claim 1 further characterized in that additional solvent is applied to the surface ahead of the mixture.

3. The method of claim 1 further characterized in that the method is carried out in a generally rectilinear back-and-forth pattern on the surface in a plurality of generally parallel adjacent paths, and further including the step of applying additional solvent to an adjacent path at the same time that the mixture is being applied.

4. The method of claim 1 further characterized in that the step of mechanically agitating the mixture, and at the same time, abrading the membrane includes the step of peripherally and generally uniformly applying discrete and intermittent interfering abrasiveness to the surface with the mixture in intimate association therewith so that the membrane will be abraded and disrupted and, at the same time, the membrane's adherence to the surface will be interrupted so that the mixture will be effective both in loosening its adherence to the surface and in dissolving the membrane into the mixture to form an emulsion.

5. The method of claim 1 further characterized in that the step of applying the mixture to the surface includes applying both the solvent and the acid at the same time.

6. The method of claim 12 further characterized in that the step of applying the mixture to the surface includes applying additional solvent first and the mixture a predetermined time thereafter.

7. The method of claim 1 further characterized by and including the step of including sufficient water initially in the mixture so that the membrane will be floated from the surface as it is agitated but not enough water to activate the acid.

8. The method of claim 1 further characterized in that the step of further agitating and abrading the surface is done mechanically.

9. The method of claim 1 further characterized in that the step of further agitating and abrading the surface is done hydraulically.

10. In a disc brush adapted to be rotated about a generally upright axis, a disc-like backing annulus with an opening in the center thereof, bristles projecting from the lower surface of the annulus with an opening in the center conforming generally to the center opening in the annulus, a flexible sleeve in the center opening of the annulus, the sleeve being in sealing relationship to the backing annulus and extending slightly beyond the ends of the bristles in a free state so that the sleeve will be in contact with and will form a fluid duct to the surface being worked upon when in use.

11. The structure of claim 10 further characterized by and including a plurality of spaced slots along the lower edge of the sleeve to allow for some spreading thereof when in contact with the surface being worked upon.

* * * * *